United States Patent [19]

Nishiike et al.

[11] Patent Number: 4,906,530

[45] Date of Patent: Mar. 6, 1990

[54] GRAIN ORIENTED ELECTROMAGNETIC STEEL SHEETS HAVING A VERY LOW IRON LOSS

[75] Inventors: Ujiihiro Nishiike; Yasuhiro Kobayashi; Hirotake Ishitobi; Shiqeko Sujita; Norio Takahashi; Hisanao Nakahara; Yukio Inokuti, all of Chiba, Japan

[73] Assignee: Kawasaki Steel Corp., Japan

[21] Appl. No.: 225,546

[22] Filed: Jul. 28, 1988

[30] Foreign Application Priority Data

Aug. 1, 1987 [JP] Japan ..... 62-191520
Aug. 1, 1987 [JP] Japan ..... 62-191521

[51] Int. Cl.[4] ..... B23P 9/00

[52] U.S. Cl. ..... 428/614; 148/307; 428/687

[58] Field of Search ..... 148/307, 308, 309; 428/682, 684, 687, 614

[56] References Cited

U.S. PATENT DOCUMENTS

| | | | |
|---|---|---|---|
| 3,523,881 | 8/1970 | Hirst et al. | 148/307 |
| 3,930,905 | 1/1976 | Akerblom | 148/307 |
| 3,932,236 | 1/1976 | Wada et al. | 148/308 |
| 4,698,272 | 10/1987 | Inokuti et al. | 148/308 |

FOREIGN PATENT DOCUMENTS

| | | |
|---|---|---|
| 52-24499 | 7/1977 | Japan . |
| 54-23647 | 8/1979 | Japan . |
| 57-2252 | 1/1982 | Japan . |
| 57-188810 | 11/1982 | Japan . |
| 58-5968 | 2/1983 | Japan . |

*Primary Examiner*—Robert McDowell
*Attorney, Agent, or Firm*—Austin R. Miller

[57] ABSTRACT

A grain oriented electromagnetic steel sheet having a very low iron loss is obtained by subjecting a surface of base metal in the sheet after finish annealing to a particular mechanical polishing and has a surface roughness having a center-line average roughness of not more than 0.3 μm after the polishing and the number of abrasive grains embedded in a layer just beneath polished surface of not more than 20,000 grains/cm².

5 Claims, 3 Drawing Sheets

Vitrified Grindstone
Abrasive Grain Containing Roll
Roll with Free Abrasive Grain
Degradation
0.25
0.20
0.15
0.25
0
0.05
0.10
Improvement
Degradation
ΔW17/50 (W/Kg)
0
2
4
6
8
10
12
Removed Depth (μm)
Mechanical Polishing
Chemical Polishing

GRAIN ORIENTED ELECTROMAGNETIC STEEL SHEETS HAVING A VERY LOW IRON LOSS

BACKGROUND OF THE INVENTION

1. Field of the Invention

This invention relates to grain oriented electromagnetic steel sheets having a very low iron loss and a method of producing the same, and more particularly to a grain oriented electromagnetic steel sheet, in which the surface of base metal in this sheet after finish annealing is smoothened up to a surface roughness having a center-line average roughness Ra of not more than 0.3 μm through mechanical polishing before the formation of insulating coating, and a method of smoothening the steel sheet through such a mechanical polishing, particularly, mechanical polishing with free abrasive grains or elastomeric polishing member containing abrasive grains.

2. Related Art Statement

The grain oriented electromagnetic steel sheets are mainly used as a core material for transformers and other electrical machineries, so that they are more strongly demanded to have excellent magnetic properties, particularly a very low iron loss (exemplified by $W_{17/50}$ value).

As to such demands, there have hitherto been developed a method of highly aligning secondary recrystallized grains of <100> orientation in the steel sheet into the rolling direction thereof, a method of reducing impurities contained in a final product and the like, whereby it was possible to reduce the $W_{17/50}$ value of the sheet having a thickness of 0.23 mm to about 0.9 W/kg.

However, it strongly tends to request electrical machinery and apparatus having less power loss on the border of energy crisis since several years. For this purpose, it becomes demanded to develop grain oriented electromagnetic steel sheets having much lower iron loss as a core material for these machineries and apparatuses.

In general, as the fundamental technique for reducing the iron loss of the grain oriented electromagnetic steel sheet, there are mainly known metallurgical methods such as method of increasing the Si amount, method of thinning the thickness of the product, method of finely dividing the secondary recrystallized grains, method of reducing the impurity amount, method of highly aligning the secondary recrystallized grains of (100)[001] orientation and the like. However, these techniques already arrive at the limit in view of the existing production technique, so that further improvement is very difficult. Even if the improvement is somewhat observed, the effectivenesss of improving the iron loss is still lacking at the present.

In Japanese Patent Application Publication No. 54-23,647, there is proposed a method of finely dividing the secondary recrystallized grains by forming secondary recrystallization preventing regions in the steel sheet surface, but this method can not be said to be practical because the control of secondary recrystallized grain size is unstable.

Furthermore, a technique of reducing the iron loss by introducing microstrain into the surface of the steel sheet after the secondary recrystallization with steel sheets for use in a ball-pointed pen to conduct magnetic domain refinement is disclosed in Japanese Patent Application Publication No. 58-5,968, and a technique of conducting magnetic domain refinement for the reduction of the iron loss by irradiating a laser beam to the surface of the final product in a direction substantially perpendicular to the rolling direction at an interval of few mm to introduce high dislocation density regions into the surface layer of the steel sheet is disclosed in Japanese Patent Application Publication No. 57-2,252. Moreover, a technique of reducing the iron loss by introducing microstrain into the surface layer of the steel sheet through discharge working to conduct magnetic domain refinement is proposed in Japanese Patent laid open No. 57-188,810.

These three techniques attempt the reduction of iron loss by introducing micro plastic strain into the base metal surface of the steel sheet after the secondary recrystallization to conduct magnetic domain refinement and are alike practical and excellent in the effect of reducing iron loss, but have a drawback that the effect by the introduction of micro plastic strain is undesirably diminished by subsequent strain relief annealing treated after punching, shearing or winding of steel sheet or by heat treatment such as baking of coating layer. Moreover, when the introduction of micro plastic strain is carried out after the coating, it is required to conduct reapplication of insulating coating for maintaining the insulation property, which largely increases the steps such as strain giving step, reapplication step and the like and brings about the increase of the cost.

Besides, Japanese Patent Application Publication No. 52-24,499 discloses that the surface of the silicon steel sheet after the finish annealing is pickled to remove oxides from the surface thereof and rendered into a mirror finished state by subjecting to a chemical polishing or electrolytic polishing to improve the magnetic properties and particularly reduce the iron loss.

In this case, however, the chemical polishing or electrolytic polishing for the mirror finishing is required, so that the cost becomes very high, and consequently such a polishing has a conspicuous difficulty in the actual application to industrial process and is not yet adopted in the mass production.

Furthermore, it is difficult that a phosphate series tension coat usually used as a tension insulating coating for the grain oriented silicon steel sheet is closely formed on the mirror finished surface of the sheet without damaging good magnetic properties obtained by the smoothening of the surface.

If it is intended to cut the expenses by replacing the above expensive polishing step with a mechanical polishing step using, for example, grindstone or the like, the remaining strain through the mechanical polishing is given to the silicon steel sheet, resulting in the considerable degradation of iron loss, so that such a mechanical polishing is impossible to be put into practical use.

SUMMARY OF THE INVENTION

It is, therefore, an object of the invention to provide a grain oriented electromagnetic steel sheet having an iron loss considerably reduced by smoothening base metal surface of the sheet after finish annealing through a low cost mechanical polishing technique.

It is another object of the invention to advantageously apply a mechanical polishing technique, which is easy in the industriallization, to the production of grain oriented electromagnetic steel sheets having a low iron loss when the polishing is applied to the base metal surface of the sheet after the finish annealing prior to the formation of the insulating coating.

According to a first aspect of the invention, there is the provision of a grain oriented electromagnetic steel sheet having a very low iron loss, characterized in that a surface of base metal in said steel sheet after finish annealing has a surface roughness having a center-line average roughness (Ra) of not more than 0.3 μm through a mechanical polishing of giving a slight strain to said base metal surface, and the number of abrasive grains embedded in a layer just beneath the polished surface is not more than 20,000 grains/cm$^2$.

According to a second aspect of the invention, there is the provision of a method of producing a grain oriented electromagnetic steel sheet having a very low iron loss by polishing a surface of base metal in said steel sheet after finish annealing to have a center-line average roughness (Ra) of not more than 0.3 μm, characterized in that said polishing is a mechanical polishing of giving a slight strain to said base metal surface.

In a preferred embodiment of the invention, the base metal of the grain oriented electromagnetic steel sheet is provided at its polished surface with a plated layer having a good bonding property to the base metal without damaging the magnetic properties, which is formed through a plating process, and an insulating coating formed thereon. In another preferred embodiment of the invention, the mechanical polishing is carried out with an elastomeric polishing member using free abrasive grains or an abrasive grain containing elastomeric polishing member.

BRIEF DESCRIPTION OF THE DRAWINGS

The invention will be described with reference to the accompanying drawings, wherein.

DESCRIPTION OF THE PREFERRED EMBODIMENTS

Figure 1:
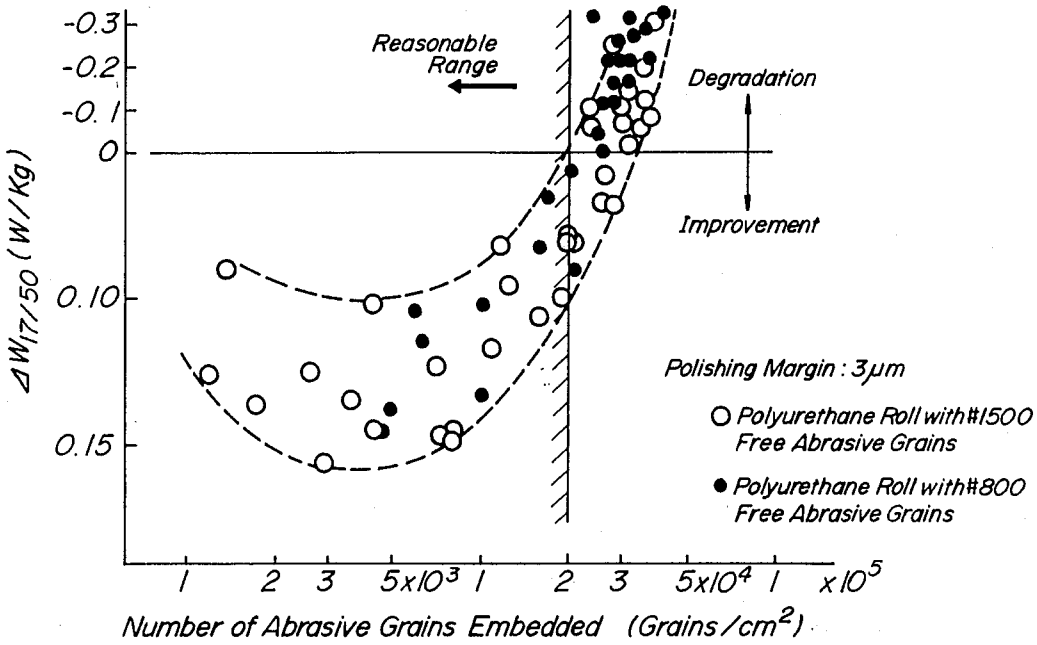
FIG. 1 is a graph showing a relation between number of abrasive grains embedded and iron loss difference before and after polishing.

The inventors have made studies with respect to the mechanical polishing applied for smoothening the surface of base metal in the grain oriented electromagnetic steel sheet after the finish annealing and found that the degree of degradation of magnetic properties differs in accordance with the kind of the mechanical polishings. Further, the inventors have made investigations with respect to various mechanical polishing methods and found that the polishing conditions for providing good magnetic properties are existent for the smoothening of the sheet surface. That is, the invention is based on these knowledges.

According to the invention, the grain oriented electromagnetic steel sheet after the finish annealing is used as a starting material. In other words, the production of the steel sheet before the finish annealing step is carried out in the conventionally known manner as follows. That is, a starting material for this sheet is melted in the conventionally known steel making furnace such as LD converter, electric furnace or the like and then cast into a slab, for example, by a continuous casting process. The resulting slab is hot rolled and subjected to a heavy cold rolling at once or to a two-time cold rolling through an intermediate annealing. In this case, a normalized annealing of the hot rolled sheet or a warm rolling instead of the cold rolling may be performed, if necessary. Thereafter, the cold rolled sheet is subjected to decarburization and primary recrystallization annealing and coated with a slurry of an annealing separator and then subjected to a finish annealing consisting of a secondary recrystallization annealing and a purification annealing.

According to the invention, in order to obtain a smooth surface having a surface roughness of not more than 0.3 μm as a center-line average roughness (Ra), the mechanical polishing is applied to the surface of base metal in the grain oriented electromagnetic steel sheet after the above finish annealing because if the smoothening treatment is carried out before the finish annealing, the surface of the sheet is rendered into a magnetically rough surface by an oxide formed on the sheet surface during the finish annealing. It is needless to say that the effect aimed at the invention is achieved by the mechanical polishing of giving a slight strain to the base metal surface after the finish annealing irrespective of the various treating steps before the finish annealing such as controls of Si amount, inhibitor amount and sheet gauge, kind of annealing separator and the like.

Namely, the main object of the invention lies in the utilization of a phenomenon that the hysteresis loss is reduced by smoothening the surface of the grain oriented electromagnetic steel sheet after the finish annealing, so that the invention is not quite dependent upon the production steps of the steel sheet itself.

The reason why the center-line average roughness (Ra) relating to the surface roughness of the base metal according to the invention is limited to not more than 0.3 μm is due to the fact that when Ra exceeds 0.3 μm, the smoothening effect contributing to the mitigation of hysteresis loss is completely lost.

Furthermore, the reason why the number of abrasive grains embedding and remaining in a layer just beneath the polished surface in the mechanical polishing is limited to not more than 20,000 grains/cm$^2$ will be described below.

In general, the conventional mechanical polishing degrades the magnetic properties. That is, when the mechanical polishing is carried out in the usual manner with a rotating grindstone or emery abrasion paper, the magnetic properties (particularly, low iron loss) are degraded due to the increase of coercive force Hc. In other words, the coercive force is increased to increase the hysteresis loss, whereby the degradation of iron loss is caused.

The inventors have examined a relation between such a degradation phenomenon and a base metal surface after the polishing and found that when the conventional mechanical polishing is performed on the sheet surface, the abrasive grains are embedded in a layer just beneath the polished surface to produce a large strain, which degrades the iron loss. Now, the inventors have made studies with respect to various mechanical polishings and found out that the magnetic properties of the grain oriented electromagnetic steel sheets are improved when the surface of base metal in this sheet after finish annealing is subjected to a mechanical polishing of giving a slight strain to the base metal surface. The term "mechanical polishing of giving a slight strain to the base metal surface" is a mechanical polishing with free abrasive grains or a mechanical polishing with abrasive grain containing elastomeric polishing member. In this connection, FIG. 1 shows a relation between number of abrasive grains embedded and iron loss difference before and after the polishing in the finish annealed surface of the grain oriented electromagnetic steel sheet when the surface of base metal after the removal of oxide formed thereon is subjected to a mechanical polishing with free abrasive grains at a polishing margin of 3 μm under various polishing conditions. As seen from FIG. 1, the magnetic properties are improved by the above mechanical polishing so as to satisfy the number of abrasive grains embedded with a range of not more than 20,000 grains/cm$^2$.

There are many factors exerting on the number of abrasive grains embedded. For example, the number of abrasive grains embedded becomes generally small as the pushing force of the polishing member (polishing roll or the like) is small or the grain size of the abrasive grain is small. In any case, the magnetic properties are different in accordance with the polishing method including the kind and material of the polishing roll, the revolution number, and the kind and application of polishing liquid, but are dependent upon the state of the surface layer the polishing or the number of abrasive grains embedded in the surface layer. As seen from FIG. 1, the maximum value of the iron loss difference appears in such a region that the number of abrasive grains embedded is approximately $3\sim5\times10^3$ grains/cm$^2$, and the magnetic properties are generally improved at the number of abrasive grains embedded of not more than 20,000 grains/cm$^2$.

This is considered to be based on an unexpected effect that when the abrasive grains are embedded in the layer just beneath the polished surface as mentioned above, a slight strain given to the base metal surface through the polishing rather gives a so-called tensile effect to the iron loss.

The mechanical polishing with free abrasive grains for approaching the number of abrasive grains embedded to zero can not be realized up to the present. On the other hand, the improvement of iron loss to about 0.10 W/kg on average is achieved even when the smoothening is carried out by the conventional chemical polishing or the like. According to the invention, therefore, in order to obtain the iron loss equal to that of the conventional chemical polishing, the upper limit of the number of abrasive grains embedded should be 20,000 grains/cm$^2$.

In the mechanical polishing according to the invention, there is used an elastomeric polishing member containing abrasive grains or an elastomeric polishing member with free abrasive grains. The elastomeric polishing member is a roll or brush of an elastomer such as polyurethane, nylon or the like having a Shore hardness of 30–70. The abrasive grain has a grain size of not more than #800 and includes silicon carbide, alumina, silica, carbon and the like. When the Shore hardness is less than 30, a considerably long time for polishing the steel sheet is required, while when it exceeds 70, a large plastic strain is introduced into the steel sheet to considerably degrade the iron loss property. On the other hand, when the grain size of the abrasive grain is more than #800, the surface roughness having a center-line average roughness of not more than 0.3 μm can not be obtained.

In case of using the abrasive grain containing elastomeric polishing member, the base metal is polished at a polishing rate of not more than 3,000 m/min under a vertical pushing force of not more than 5 kg/cm$^2$ toward the base metal surface. In case of using the elastomeric polishing member with free abrasive grains, the base metal is polished by rotating the elastomeric polishing member at a polishing rate of not more than 4,000 m/min under a vertical pushing force of not more than 5 kg/cm$^2$ and simultaneously supplying the abrasive grains or a polishing dispersion thereof between the base metal and the elastomeric polishing member onto the surface to be polished.

Figure 2:
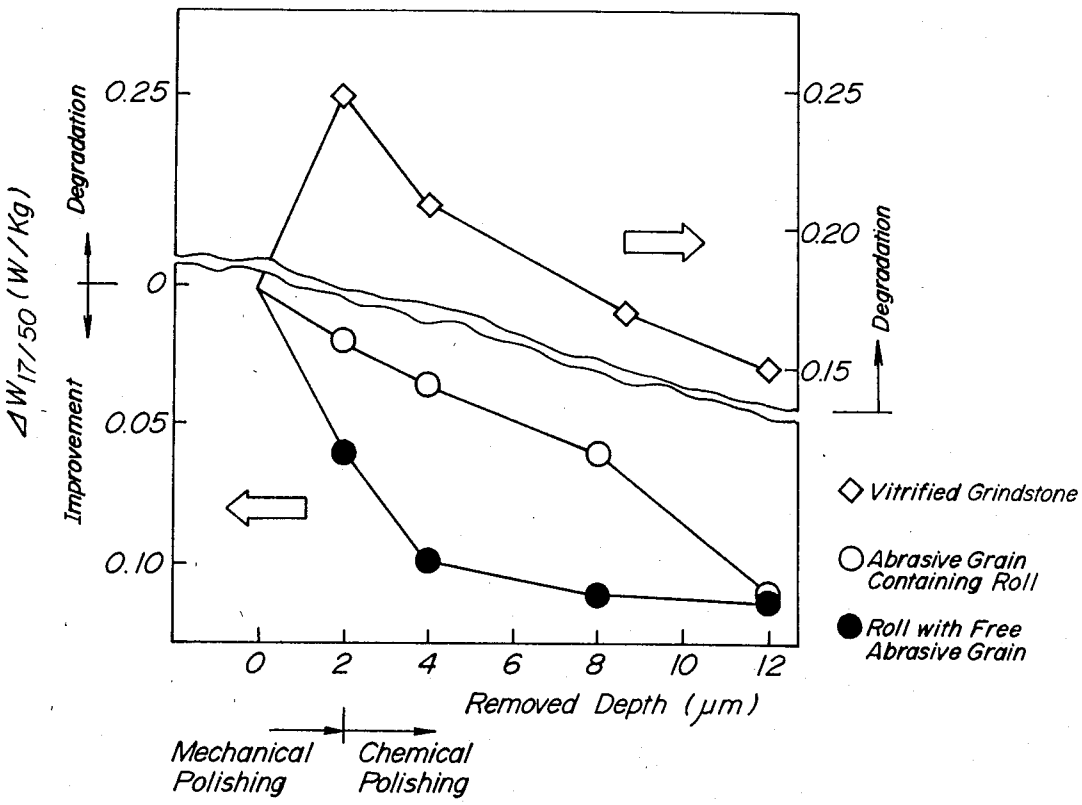
FIG. 2 is a graph showing a comparison among polishing with a rotating grindstone, polishing with an abrasive grain containing roll and polishing with free abrasive grains.

In general, the mechanical polishing brings about the formation of machined surface layer and hence the degradation of magnetic properties, particularly hysteresis loss as previously mentioned. In this connection, the inventors have made various examinations and found that the above degradation of magnetic properties mainly results from a strain based on vertical moment of the polishing member and abrasive grains applied to the base metal surface during the polishing and a strain produced by peeling off or squeezing abrasive grains from the polishing member to embed the abrasive grains into the layer beneath the polished surface. FIG. 2 shows a comparison among mechanical polishing with free abrasive grains and mechanical polishing with abrasive grain containing elastomeric polishing member according to the invention and the conventional mechanical polishing with the rotating grindstone.

In FIG. 2, the difference of iron loss ($W_{17/50}$) before and after the mechanical polishing in a grain oriented electromagnetic steel sheet containing C: 0.002% and Si: 3.1% and having a usual forsterite film as an insulation coating after the finish annealing is plotted on an ordinate.

In the first polishing method, there was used a #1000 rotating grindstone (vitrified grindstone), while in the second and third polishing methods, there was used a sponge roll of polyurethane having a compression Young's modulus of not more than 104 kg/cm$^2$ and green silicon carbide grains of #1000 (GC) as an abrasive grain. The use of the sponge roll was to lessen the vertical pushing force applied to the sheet surface.

In the mechanical polishing according to the second method, the abrasive grains were dispersed in a polishing liquid and supplied to the sheet surface to be polished, while the sponge roll containing abrasive grains was used in the third method. Moreover, the pushing force of the roll to the sheet surface was 3 kg/cm$^2$.

In all of these methods, the mechanical polishing was carried out at a polishing margin of 2 μm from the sheet surface. Thereafter, the sheet was subjected to a chemical polishing with a polishing solution of 3% HF and ethyl alcohol so as to provide a total polishing margin of 12 μm. After the completion of the chemical polishing, the Ra of the sheet surface was about 0.2 pm.

As seen from FIG. 2, the second and third polishing methods contribute to reduce the iron loss as compared with the first polishing method using the conventional rotating grindstone. Particularly, the improvement of iron loss value is considerably large in the mechanical polishing with free abrasive grains than the mechanical polishing with the abrasive grain containing roll.

When the total polishing margin reaches 12 μm per one-side surface, the iron loss difference is substantially same in the second and third methods. However, the iron loss value at a stage that the polishing margin does not reach the total value of 12 μm is good in the mechanical polishing with free abrasive grains as compared with the mechanical polishing with the abrasive grain containing roll. This is considered to be due to the fact that the thickness of abrasive grain embedded layer is fairly thin and the number of abrasive grains embedded is small and the strain applied to the base metal is small in the mechanical polishing with free abrasive grains as compared with the mechanical polishing with the abrasive grain containing roll.

Similarly, this tendency is caused in mechanical polishings with a brush using free abrasive grains and an abrasive grain containing brush.

Figure 3:
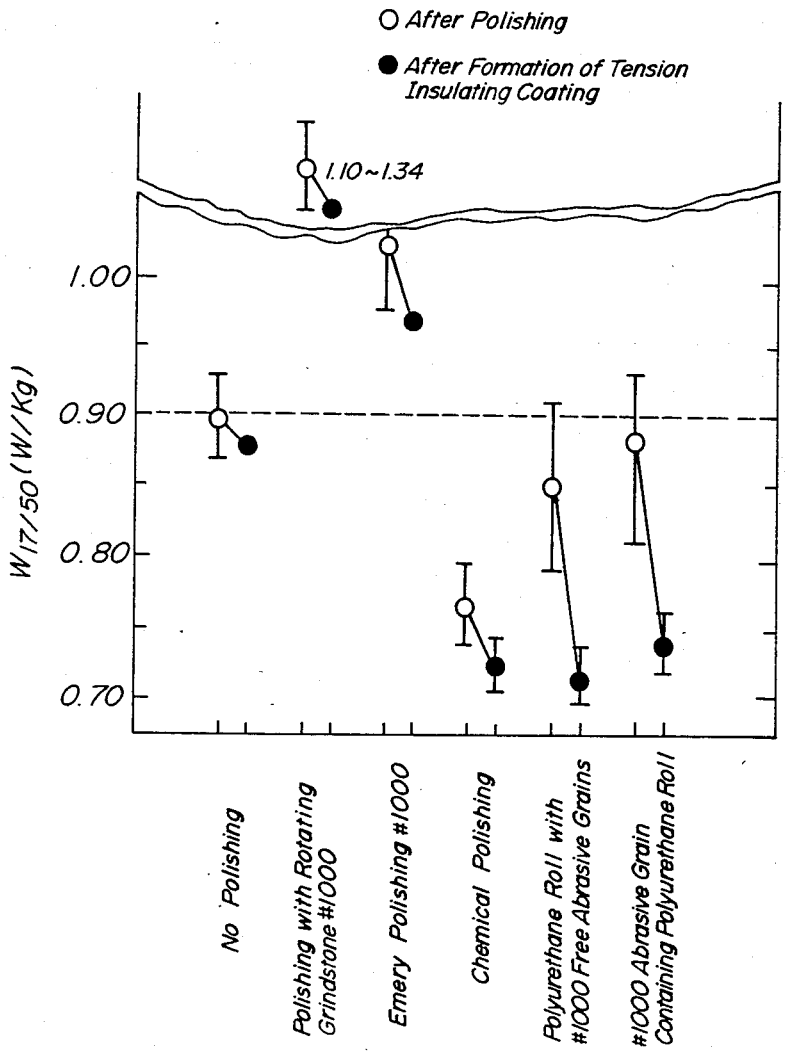
FIG. 3 is a graph showing a relation of various polishing materials to iron loss.

For the comparison, FIG. 3 shows the iron loss Value ($W_{17/50}$) when the same test sheet was subjected to each of the mechanical polishings with the conventional rotating grindstone (vitrified grindstone of #1000), conventional emery abrasion paper, polyurethane polishing roll containing alumina abrasive grains and polyurethane polishing roll using free alumina abrasive grains or the conventional chemical polishing, respectively.

As seen from FIG. 3, the undesirable degradation of iron loss is observed in the mechanical polishings with the conventional rotating grindstone and emery abrasion paper giving unnecessary strain to the base metal surface during the polishing, while the iron loss is considerably reduced by the conventional chemical polishing. Therefore, it has hitherto been obliged to use the chemical polishing (or electrolytic polishing) instead of the mechanical polishing, but this chemical polishing is very high in the cost and unsuitable for the industrial production. On the contrary, the mechanical polishing according to the invention achieves the iron loss value considerably close to that of the conventional chemical polishing, so that it is considerably suitable for the industrial production of the grain oriented electromagnetic steel sheets having a very low iron loss.

When a tension insulating coating, particularly a tension coat is formed on the smoothened surface of the grain oriented electromagnetic steel sheet obtained by the mechanical polishing according to the invention, the iron loss value is considerably improved. This is considered to be due to the fact that the tension effect largely acts to the smoothened surface. According to the invention, therefore, it is more advantageous to provide the tension coat as a tension insulating coating on the smoothened surface of the grain oriented electromagnetic steel sheet after the mechanical polishing.

That is, after the finish annealed surface of the base metal in the grain oriented electromagnetic steel sheet is subjected to mechanical polishing according to the invention, the insulating coating, especially tension insulating coating is formed on the polished surface, whereby the iron loss can further be reduced. Particularly, when a tension insulating coating is formed by using a coating solution of colloidal silica and a phosphate, it is favorable that a plated layer acting as a binder between the base and the tension insulating coating is previously formed on the polished surface. Furthermore, a tension coat consisting of at least one of metal carbides, nitrides and oxides may directly be formed on the polished surface through PVD or CVD process.

As is well-known, the tension insulating coating is obtained, for example, by baking the coating solution of colloidal silica and phosphate at about 800° C. into amorphous state. However, if it is intended to directly and sufficiently adhere the tension insulating coating to the polished surface of the base metal, the coating is apt to peel off from the polished surface in the subsequent strain relief annealing at about 800° C. For this reason, there were hitherto been adopted a method of causing any chemical reaction on the tension insulating coating, a method of producing an oxide on the polished surface before the formation of the coating and the like. However, these methods ensure the bonding property but lose the surface smoothening effect, so that the iron loss value turns back to a level before the smoothening treatment. In this connection, according to the invention, the polished surface of the base metal is subjected to a plating for holding the smoothness without losing the smoothening effect, so that the resulting plated layer acts as a binder to the tension insulating coating and consequently the bonding property is good and the sufficient tension effect and smoothening effect can be developed.

In the formation of the plated layer acting as a binder, when the tension insulating coating may be baked on the plated layer directly or through phosphating treatment, oxidizing treatment or the like, any plating process such as wet plating and dry plating inclusive of PVD and CVD, any plating materials such as metal, oxide, carbide, nitride and the like, and any number of plated layers are adapted. Moreover, a certain plating material is expected to develop the tension applying effect among the above plating materials. In any case, it is required to give a bonding property enough to maintain the smoothness of tee base metal during the plating. The following Table 1 shows the iron loss values before and after the formation of the tension insulating coating, the improvement of iron loss and the bonding property with or without the plating treatment.

TABLE 1

| | Iron | Copper | Nickel | TiN (PVD) | TiN (CVD) | No plating |
|---|---|---|---|---|---|---|
| Iron loss before coating | 0.78 | 0.80 | 0.85 | 0.76 | 0.77 | 0.81 |
| Iron loss after coating | 0.75 | 0.77 | 0.79 | 0.73 | 0.73 | 0.86 |
| Improving range | Δ 0.03 | Δ 0.03 | Δ 0.06 | Δ 0.03 | Δ 0.04 | ▲0.05 |
| Bonding property | ◎ | ○ | ◎ | ◎ | ◎ | x |

◎ EXCELLENT
○ GOOD
Δ IMPROVED
▲ DETERIORATED
x BAD OR POOR

As seen from Table 1, when the tension insulating coating is formed after the plating, the bonding property is considerably excellent and the improvement of the iron loss value is large as compared with the case of performing no plating.

The following examples are given in illustration of the invention and are not intended as limitations thereof.

EXAMPLE 1

A hot rolled sheet of silicon steel containing C: 0.035% and Si: 3.2% and using MnSe+MnS inhibitor was subjected to a cold rolling in the usual manner.

After decarburizing annealing, it was coated with slurry of an annealing separator consisting of $Al_2O_3$ and MgO and then subjected to a finish annealing to obtain a test sheet A having a thickness of 0.20 mm. Furthermore, the same cold rolled sheet as described above was coated with a slurry of an annealing separator consisting of $Al_2O_3$ and then subjected to a finish annealing to obtain a test sheet B having a thickness of 0.18 mm. These test sheets had a center-line average roughness (Ra) of 0.45 μm. Then, each of these test sheets was mechanically polished with each of a #1000 emery endless grindstone (Comparative Example 1: excessive embedding amount), a #200 abrasive grain containing nonwoven fabric roll (Comparative Example 2: outside Ra range) and a polyurethane roll using free #800 abrasive grains (Acceptable Example) so as to provide Ra of not more than 0.15 μm except Comparative Example 2. The measured values of iron loss every step are shown in the following Table 2.

TABLE 2

| | | Surface roughness μm (Ra) | Number of abrasive grains embedded grains/cm$^2$ | Iron loss of sheet A (0.20 mm) $W_{17/50}$ (W/kg) | Iron loss of sheet B (0.20 mm) $W_{17/50}$ (W/kg) |
|---|---|---|---|---|---|
| After finish annealing | | 0.45 | — | 0.96 | 0.95 |
| Comparative Example 1 | after polishing (#1000 emery endless) | 0.09 | ~5 × $10^4$ | 1.35 | 1.41 |
| Comparative Example 2 | after polishing (#200 abrasive grain containing nonwoven fabric roll) | 0.32 | ~3 × $10^4$ | 1.01 | 0.99 |
| Acceptable Example | after polishing (polyurethane roll using #800 free abrasive grains) | 0.15 | ~1 × $10^3$ | 0.81 | 0.79 |

Then, the polished surface of the test sheet according to the invention was subjected to Fe plating at a thickness of 1 μm and a tension insulating coating was formed thereon. When comparing with the sheet directly covered with the coating without plating, the iron loss value was 0.78 W/kg in the sheet A and 0.75 W/kg in the sheet B, and the bonding property was good.

When the sheet directly covered with the coating was wound on a round rod of 3 cm in diameter, the peeling of the coating was caused to judge the poor bonding property, while in case of forming the coating through the plated layer, no peeling was caused and the bonding property was good.

As mentioned above, when the mechanical polishing is carried out with free abrasive grains according to the invention, the improvement of magnetic properties is remarkable, and particularly when the tension insulating coating is formed on the polished surface through the plated layer, the magnetic properties are further improved with good bonding property.

EXAMPLE 2

A hot rolled sheet of silicon steel containing C: 0.042% and Si: 3.1% and using AlN inhibitor was subjected to a cold rolling in the usual manner. After decarburizing annealing, it was coated with slurry of an annealing separator consisting of MgO and then subjected to a finish annealing to obtain a test sheet having a thickness of 0.27 mm. Then, the test sheet was subjected to a mechanical polishing with each of a #200 abrasive grain containing nonwoven fabric roll (Comparative Example 3: outside Ra range, excessive embedding amount) and a nonwoven fabric roll using #1000 free abrasive grains (Acceptable Example) After the polishing, Ti layer of 0.5 μm in thickness was formed on the polished surface by a dry plating process (vacuum evaporation) and then a tension insulating coating was baked thereon.

The measured values of iron loss every step are shown in the following Table 3.

TABLE 3

| | | Surface roughness μm (Ra) | Number of abrasive grains embedded grans/cm$^2$ | Iron loss $W_{17/50}$ (W/kg) |
|---|---|---|---|---|
| After finish annealing | | 0.40 | — | 1.01 |
| Comparative Example 3 | after polishing (#200 abrasive grain containing nonwoven fabric roll) | 0.32 | ~3 × $10^4$ | 1.15 |
| Acceptable Example | after polishing (nonwoven fabric roll using #1000 free abrasive grains) | 0.19 | ~1.5 × $10^3$ | 0.89 |

The sheet provided with the coating through the plated layer had an iron loss ($W_{1750}$) of 0.79 W/kg and was good in the bonding property.

EXAMPLES 3 and 4

A hot rolled sheet of silicon steel containing C: 0.039% and Si: 3.2% and using MnSe +MnS inhibitor was subjected to a cold rolling in the usual manner. After decarburizing annealing, it was coated with slurry of an annealing separator consisting of MgO and then subjected to a finish annealing to obtain a test sheet C having a thickness of 0.20 mm. Furthermore, the same cold rolled sheet as described above was coated with slurry of an annealing separator consisting of $Al_2O_3$ and then subjected to a finish annealing to obtain a test sheet D having a thickness of 0.18 mm. Then, each of these test sheets was mechanically polished with each of a vitrified grindstone (Comparative Example 4), a polyurethane roll containing no abrasive grain (Comparative Example 5), a #800 abrasive grain containing polyurethane roll (Acceptable Example) and a polyurethane roll using a polishing dispersion of #800 free abrasive grains (Acceptable Example) so as to provide Ra of not more than 0.2 μm except that Ra was 0.35 0.4 μm in Comparative Example 5.

Thereafter, the polished surface was subjected to a phosphate coating as a tension insulating coating and the magnetic properties of the resulting grain oriented electromagnetic steel sheet were measured to obtain results as shown in the following Table 4.

TABLE 4

| | Magnetic property before polishing | | Comparative Example | | Acceptable Example | |
|---|---|---|---|---|---|---|
| | | | 4: vitrified grindstone | 5: polyurethane roll containing no abrasive grain | Abrasive grain containing polyurethane roll | polyurethane roll with free abrasive grains |
| | $B_{10}$ (T) | $W_{17/50}$ (W/kg) | $W_{17/50}$ (W/kg) | $W_{17/50}$ (W/kg) | $W_{17/50}$ (W/kg) | $W_{17/50}$ (W/kg) |
| Sheet C | 1.89 | 0.91 | 1.31 | 0.91 | 0.89 | 0.83 |
| Sheet D | 1.92 | 0.87 | 1.31 | 0.88 | 0.84 | 0.81 |

Moreover, the results when TiN (thickness: 1 μm) was formed on the polished surface through ion plating before the formation of the tension insulating coating are shown in the following Table 5.

TABLE 5

| | Magnetic property before polishing | | Comparative Example | Acceptable Example | |
|---|---|---|---|---|---|
| | | | 5: polyurethane roll containing no abrasive grain | Abrasive grain containing polyurethane roll | polyurethane roll with free abrasive grains |
| | $B_{10}$ (T) | $W_{17/50}$ (W/kg) | $W_{17/50}$ (W/kg) | $W_{17/50}$ (W/kg) | $W_{17/50}$ (W/kg) |
| Sheet C | 1.89 | 0.91 | 0.85 | 0.82 | 0.73 |
| Sheet D | 1.92 | 0.87 | 0.83 | 0.78 | 0.70 |

EXAMPLES 5 and 6

A hot rolled sheet of silicon steel containing C: 0.002% and Si: 3.1% and using AlN inhibitor was subjected to a cold rolling in the usual manner. After decarburizing annealing, it was coated with slurry of an annealing separator consisting of MgO and then subjected to a finish annealing to obtain a test sheet E having a thickness of 0.30 mm. Furthermore, a hot rolled sheet of silicon steel containing C: 0.001% and Si: 3.2% and using MnSe+MnS inhibitor was subjected to a cold rolling in the usual manner. After decarburizing annealing, it was coated with slurry of an annealing separator consisting of MgO and then subjected to a finish annealing to obtain a test sheet F having a thickness of 0.15 mm. Then, each of these test sheets was mechanically polished with each of a nylon brush containing no abrasive grain (Comparative Example 6), a #1000 abrasive grain containing nylon brush (Acceptable Example) and a nylon brush using a polishing dispersion of #1000 free abrasive grains (Acceptable Example) so as to provide Ra of not more than 0.2 μm except that Ra was 0.35 0.4 μm in Comparative Example 6.

Thereafter, the polished surface was subjected to a phosphate coating as a tension insulating coating and the magnetic properties of the resulting grain oriented electromagnetic steel sheet were measured to obtain results as shown in the following Table 6.

TABLE 6

| | Magnetic property before polishing | | Comparative Example | Acceptable Example | |
|---|---|---|---|---|---|
| | | | 6: Nylon brush containing no abrasive grain | Nylon brush containing abrasive grain | Nylon brush using free abrasive grains |
| | $B_{10}$ (T) | $W_{17/50}$ (W/kg) | $W_{17/50}$ (W/kg) | $W_{17/50}$ (W/kg) | $W_{17/50}$ (W/kg) |
| Sheet E | 1.93 | 0.99 | 0.98 | 0.96 | 0.94 |
| Sheet F | 1.91 | 0.81 | 0.82 | 0.79 | 0.76 |

Moreover, the results when $Si_3N_4$ was formed on the polished surface through ion plating before the formation of the tension insulating coating are shown in the following Table 7.

TABLE 7

| | Magnetic property before polishing | | Comparative Example | Acceptable Example | |
|---|---|---|---|---|---|
| | | | 6: Nylon brush containing no abrasive grain | Nylon brush containing abrasive grain | Nylon brush using free abrasive grains |
| | $B_{10}$ (T) | $W_{17/50}$ (W/kg) | $W_{17/50}$ (W/kg) | $W_{17/50}$ (W/kg) | $W_{17/50}$ (W/kg) |
| Sheet E | 1.93 | 0.99 | 0.97 | 0.92 | 0.89 |
| Sheet F | 1.91 | 0.81 | 0.79 | 0.75 | 0.72 |

EXAMPLE 7

A grain oriented electromagnetic steel sheet after finish annealing containing Si: 3.3 wt% and having an iron loss of 0.90 W/kg was mechanically polished with a polyurethane roll having a Shore hardness of 47 and containing alumina (#1000) as an abrasive grain at a polishing margin of 1 μm to have a center-line average roughness of Ra: 0.10 μm.

For the comparison, the sheet was mechanically polished with a usual rotating grindstone of alumina (#1000) having a Shore hardness of 94 at a polishing margin of 1 μm to have a center-line average roughness of Ra: 0.13 μm.

The iron loss value was measured to be 0.82 W/kg in the former case and 1.33 W/kg in the latter case.

EXAMPLE 8

A grain oriented electromagnetic steel sheet after finish annealing containing Si: 3.3 wt% and having an iron loss of 0.90 W/kg was mechanically polished with a polyurethane roll having a Shore hardness of 49 and containing silicon carbide (#1000) as an abrasive grain at a polishing margin of 1 pm to have a center-line average roughness of Ra: 0.08 μm.

For the comparison, the sheet was mechanically polished with a usual rotating grindstone of silicon carbide (#1000) having a Shore hardness of 90 at a polishing margin of 1 μm to have a center-line average roughness of Ra: 0.12 μm.

The iron loss value was measured to be 0.81 W/kg in the former case and 1.37 W/kg in the latter case.

Further, when each of these sheets was coated with TiN of 1 μm in thickness through ion plating, the iron loss value was 0.72 W/kg in the former case and 1.29 W/kg in the latter case.

EXAMPLE 9

A hot rolled sheet of silicon steel containing C: 0.036% and Si: 3.3% and using MnSe+MnS+Sn inhibitor was subjected to a cold rolling in the usual manner. After decarburizing annealing, it was coated with slurry of an annealing separator consisting of MgO and then subjected to a finish annealing to obtain a test sheet having a thickness of 0.23 mm. Then, the sheet was mechanically polished with each of a #1000 emery endless grindstone (Comparative Example 7: excessive embedding amount), a #300 abrasive grain containing nylon brush (Comparative Example 8: outside Ra range) and a #1200 abrasive grain containing nylon brush (Acceptable Example) to provide Ra of not more than 0.12 μm except that Ra was 0.33 μm in Comparative Example 8. The iron loss values measured every step are shown in the following Table 8.

TABLE 8

| | | Surface roughness μm (Ra) | Number of abrasive grains embedded grains/cm$^2$ | Iron loss $W_{17/50}$ (W/kg) |
|---|---|---|---|---|
| After finish annealing | | 0.45 | — | 0.92 |
| Comparative Example 7 | after polishing (#1000 emery endless) | 0.10 | $\sim 5 \times 10^4$ | 1.45 |
| Comparative Example 8 | after polishing (Nylon brush containing #300 abrasive grain) | 0.33 | $\sim 4 \times 10^4$ | 1.12 |
| Acceptable Example | after polishing (Nylon brush containing #1200 abrasive grain) | 0.12 | $\sim 1 \times 10^3$ | 0.80 |

Then, the polished surface was subjected to various platings at a plated thickness of 1 μm and a tension insulating coating was formed thereon. For the comparison, the tension insulating coating was directly formed on the polished surface without plating. The bonding property and iron loss value were measured to obtain results as shown in the following Table 9.

TABLE 9

| | Plated layer | Plating process | Bonding property | Iron loss $W_{17/50}$ (W/kg) |
|---|---|---|---|---|
| Unacceptable Example | none | — | poor | 0.95 |
| Acceptable Example | TiN | ion plating | good | 0.68 |
| Acceptable Example | TiC | ion plating | good | 0.69 |
| Acceptable Example | $Si_3N_4$ | ion plating | good | 0.67 |
| Acceptable Example | $Al_2O_3$ | ion plating | good | 0.69 |
| Acceptable Example | TiO | ion plating | good | 0.69 |
| Acceptable Example | TiN | CVD | good | 0.70 |

As mentioned above, according to the invention, the reduction of iron loss in the grain oriented electromagnetic steel sheet is achieved by a mechanical polishing of giving a slight strain to the base metal surface, which is not expensive in the industrial cost and easy in the mass production as compared with the conventional chemical or electrolytic polishing, and by controlling the amount of abrasive grains embedded in a layer just beneath the polished surface under a proper Ra, and also the iron loss can be more reduced with good bonding property by subjecting the polished surface to a plating and further forming a tension insulating coating thereon.

What is claimed is:

1. A grain oriented electromagnetic steel sheet having a very low iron loss, wherein a surface of base metal in said steel sheet after finish annealing has a surface roughness having a center-line average roughness of not more than 0.3 μm through a mechanical polishing of giving a slight strain to said base metal surface, whereby abrasive grains are embedded in a layer just beneath the polished surface and the number of abrasive grains embedded is not more than 20,000 grains/cm$^2$.

2. The grain oriented electromagnetic steel sheet according to claim 1, wherein said base metal is provided at its polished surface with a plated layer formed through a plating process and an insulating coating formed thereon.

3. The grain oriented electromagnetic steel sheet according to claim 1, wherein the number of abrasive grains embedded is about 1000 grains/cm$^2$ to not more than 20,000 grams/cm$^2$.

4. The grain oriented electromagnetic steel sheet according to claim 3, wherein the center-line average roughness is from 0.08 μm to not more than 0.3 μm.

5. The grain oriented electromagnetic steel sheet according to claim 3 wherein the number of abrasive grains embedded is about 3000 grains/cm$^2$ to about 5000 grains/cm$^2$.

* * * * *

UNITED STATES PATENT AND TRADEMARK OFFICE

CERTIFICATE OF CORRECTION

PATENT NO. : 4,906,530

DATED : March 6, 1990

INVENTOR(S) : Ujihiro Nishike; Yasuhiro Kobayashi, Hirotake Ishitobi; Shiqeko Sujita; Norio Takahashi; Hisanao Nakahara, Yukio Inokuti It is certified that error appears in the above-identified patent and that said Letters Patent is hereby corrected as shown below:

Column 6, line 39, change "104" to --$10^4$--.

Signed and Sealed this

Second Day of April, 1991

*Attest:*

HARRY F. MANBECK, JR.

*Attesting Officer*

*Commissioner of Patents and Trademarks*